United States Patent [19]

Mollica

[11] 4,015,642

[45] Apr. 5, 1977

[54] SHUTTLELESS LOOM OF THE TYPE HAVING UNIDIRECTIONAL WEFT THREAD CARRIERS

[76] Inventor: Francesco Mollica, Via Cairoli, 5, Varese, Italy

[22] Filed: Feb. 23, 1976

[21] Appl. No.: 660,748

[30] Foreign Application Priority Data

Dec. 29, 1975 Italy ..... 30818/75

[52] U.S. Cl. ..... 139/438; 139/196.2

[51] Int. Cl.[2] ..... D03D 47/24

[58] Field of Search ..... 139/437, 438, 439, 443, 139/196.2

[56] References Cited

UNITED STATES PATENTS

| | | | |
|---|---|---|---|
| 3,444,902 | 5/1969 | Moessinger | 139/437 |
| 3,593,752 | 7/1971 | Moessinger | 139/439 |
| 3,750,716 | 8/1973 | Kimura et al. | 139/439 |

*Primary Examiner*—Henry S. Jaudon
*Attorney, Agent, or Firm*—Guido Modiano; Albert Josif

[57] ABSTRACT

A shuttleless loom having at least one weft thread carrier movable across the whole shed for inserting a weft thread between the warp threads, and a device for throwing and recovering the weft thread carrier. The device comprises a guide for returning the carrier which has passed across the shed to the throwing position without stopping it and means such as a flywheel for accelerating the returned carrier to confer to it the initial throw speed. The flywheel defines the inner wall of a circular guide portion tangent to a throwing and a returning portion of the guide and has means for entraining the thread carrier. A controlled throw door causes the accelerated carrier to be timely thrown out of the circular guide portion for catching the weft thread and inserting it between the warp threads.

5 Claims, 11 Drawing Figures

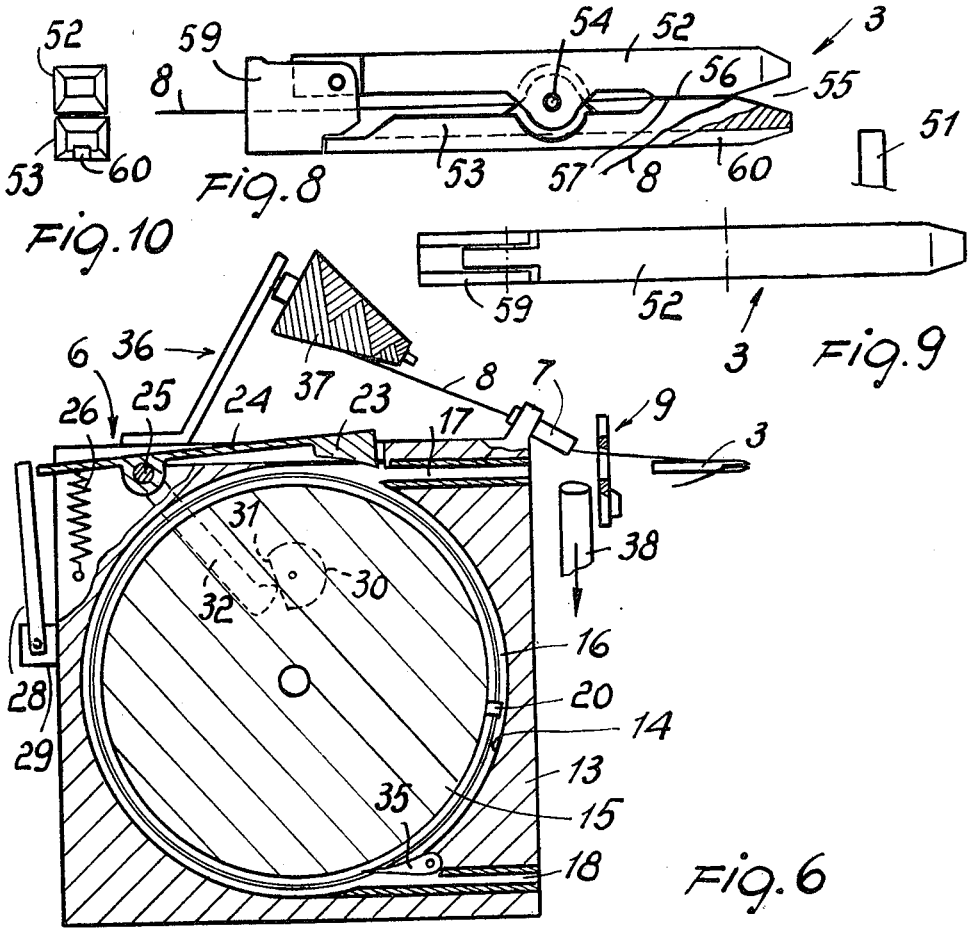
Fig. 10
Fig. 8
Fig. 9
Fig. 6
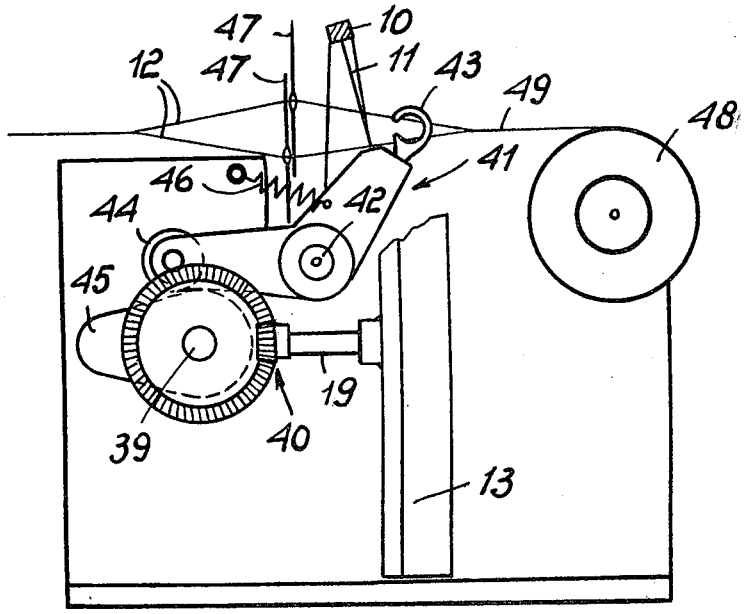
Fig. 7

SHUTTLELESS LOOM OF THE TYPE HAVING UNIDIRECTIONAL WEFT THREAD CARRIERS

BACKGROUND OF THE INVENTION

This invention relates to a shuttleless loom of the type having unidirectional weft thread carriers.

It is known that, in addition to conventional weaving looms wherein the weft thread is inserted between the warp threads by means of a shuttle, reciprocating to and fro and housing a spool or cop with the thread thereon, so called shuttleless looms have been developed, wherein the weft thread is inserted by a weft thread carrier which is spool-less and configurated such as to grip the weft thread at one side or end of the shed and release it at the opposite side or end after having crossed the whole width of the fabric. Specifically, a number of such carriers are provided, each carrier being first brought to a position for gripping the weft thread supplied by a spool arranged on a stationary support, and then thrown across the shed by means of a torsion bar which confers to the stationary carrier the necessary acceleration and velocity, as required by the weight and thickness of the weft and by the cloth width, whereafter the thread is cut off, the carrier brought to stop and then returned to its initial position, e.g. by means of a conveyor located under the warp. The carriers operate one after the other. Looms operating on this general principle are commonly referred to as Sulzer shuttleless looms.

The advantages provided by such looms over the looms of conventional design are noteworthy. Indeed, since it is no longer necessary to transfer the thread-carrying spool across the shed, it becomes possible to effect a marked reduction in the size of the movable carriers and, accordingly, in the moving masses involved, with resulting lower energy requirements and increased throwing velocities. This velocity increase brings about a remarkable increase in the production rate with respect to the traditional looms, for a given machine size.

By contrast to such advantages over the traditional looms, the shortcomings of the system just described should be taken into account. Firstly, it should be noted that the stopping of the carrier on completion of the weft insertion step causes a waste of useful energy, which becomes higher as the throwing velocity increases, that same energy amount having to be replenished on the next throw. Furthermore, the noise and vibration should not be underestimated which are constantly set up by the sudden stop of the carriers on completion of the weft insertion step. There exists also a limitation to the reciprocation speed of the sley which, when using high carrier throwing velocities, is bound to reciprocate so quickly that remarkable and unacceptable vibrations are generated as a certain throwing velocity is exceeded. The carriers themselves, owing to the mechanical stresses whereto they are constantly subjected along their tails and tips, have to be made of a suitable material. All this prevents the production rate of such known looms from exceeding a given output limit.

SUMMARY OF THE INVENTION

It is a primary object of this invention to overcome such limitations of the prior art by providing a shuttleless loom equipped with at least one unidirectional weft thread carrier, which loom is so constructed as to limit the energy consumption for a given working speed and is thus capable of higher performance rates, even at high speeds.

It is another object of the invention to provide a loom of the type described above, featuring an improved carrier throwing device which generates practically no vibration and noise.

A further object of the invention is to provide a loom of the type described above, which is capable of operating at higher speeds than hitherto possible with the conventional shuttleless looms.

These and other objects, which will appear from the following detailed description, are achieved by a shuttleless loom of the type having at least one unidirectional weft thread carrier, comprising a throwing and recovering device for said carrier, wherein said device includes a guide for said carrier between the carrier emergence area from the shed and the insertion area thereof into the shed, said guide having progressive deviation and reversal portions, respectively at said emergence area from the shed and said insertion area into the shed, and means in said guide for accelerating said carrier to bring it back to the initial throwing velocity.

Advantageously, said progressive deviation and reversal portions are respectively composed of a substantially "U"-shaped guide portion at the carrier emergence area from the shed, and of a circular guide portion at the carrier insertion area into the shed, said circular guide portion being substantially tangent to a linear return portion and linear throw portion of said guide, respectively, said acceleration means comprising a flywheel defining the inner wall of said circular guide portion and provided with entraining means for said carrier, means being further provided for controlling the throwing of said carrier out of said circular guide portion.

With such an approach, the carrier is no longer slowed down and stopped at the end of the shed crossing step and its throw energy no longer totally destroyed, as is the case with the Sulzer loom at the moment of impinging against the stop surface at the emergence from the shed, but is rather recovered for the most part, there occurring only a minimal loss due to resistances and friction. Since the carrier substantially maintains its throw energy, deducting the obvious losses, until it is returned to the throwing area, all that is required is to supply each carrier, before each new throw cycle, with that amount of energy as went lost during its motion. That energy amount may be supplied to the carrier during one or more revolutions within the circular guide, as entrained about by the flywheel. All this results in higher output rates than were obtainable with the Sulzer type of loom. Thanks to the higher carrier velocity provided, more time remains available for reciprocating the sley, which is then reciprocable at lower rates, thereby less vibration is generated. The re-use of the carrier energy leads to improved loom performance.

BRIEF DESCRIPTION OF THE DRAWINGS

Further features and advantages of the invention will become apparent from the following description of a preferred embodiment thereof, provided by way of example and illustrated in the accompanying drawings, in which:

FIG. 6 is a view similar to FIG. 2 but illustrating the carrier throwing step;

FIG. 7 is a schematic elevational view of a loom according to the invention;

FIG. 8 shows a carrier for a loom according to this invention, the carrier being shown during the weft thread pick up step;

FIGS. 9 and 10 are, respectively, a top plan view and a front view of the carrier shown in FIG. 8.

DESCRIPTION OF THE PREFERRED EMBODIMENT

Figure 1:
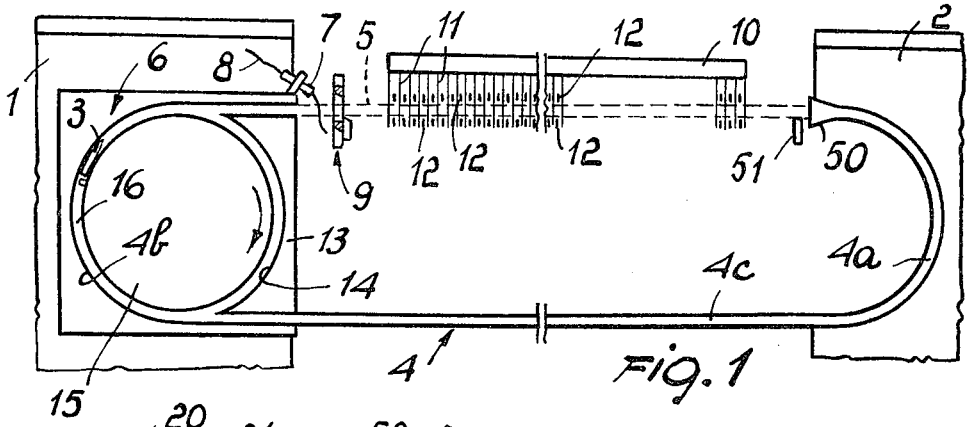
FIG. 1 is a cross-sectional general layout view of a loom according to the invention, some details of the throwing and recovering device being omitted and appearing instead in the following figures.
Figure 5:
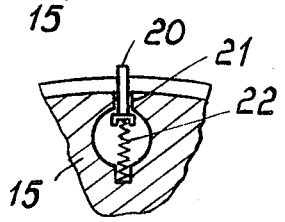
FIG. 5 shows a detail of the carrier entraining means in the throwing device.
Figure 11:
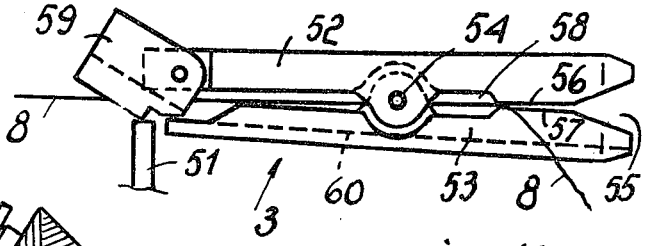
FIG. 11 shows the carrier of FIG. 8 at the moment of releasing the weft thread.

With reference initially to FIG. 1 of the drawings, the loom according to the invention comprises two side frames 1 and 2, between which the device for throwing and recovering the carrier 3 is located, the device comprising a guide 4 for the carrier, arranged to cause the carrier to move along a closed path one portion of which passes through the shed. The guide 4 includes arcuate deviation portions 4*a* and 4*b* at opposite sides of the loom for the progressive deviation and reversal of the carrier 3 from the linear throwing portion 5 to the linear return portion 4*c*, and viceversa.

The reference numeral 6 denotes generally the throwing assembly, to be described in detail hereinafter, while the numeral 7 denotes a thread guide for the weft thread 8, and 9 denotes a cutting device. The numeral 10 denotes the sley, of conventional design, carrying the reed 11, while 12 denotes the warp threads wherebetween the shed is defined.

Figure 2:
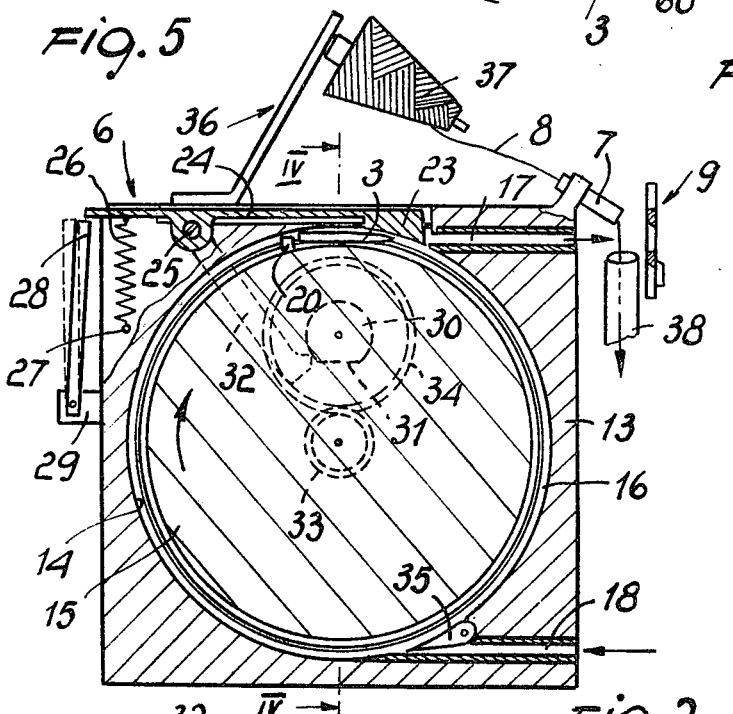
FIG. 2 shows a detail of the throwing device in sectional view along the line II—II of FIG. 4.
Figure 4:
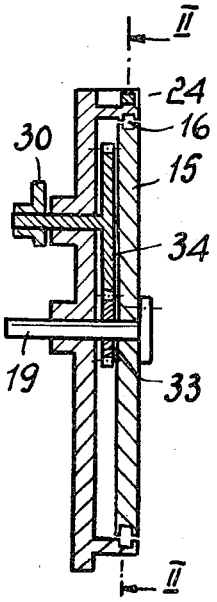
FIGS. 3 and 4 show respectively a top view and a cross-sectional view along the line IV—IV of the device illustrated in FIG. 2.
Figure 3:
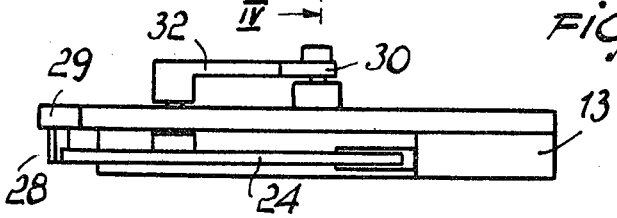

The throwing assembly or device 6, shown enlarged in FIG. 2, comprises a supporting structure 13 affixed to the side frame 1 and defining a circular recess or cavity 14 wherein a flywheel 15 is rotatably mounted, the cavity 14 and the flywheel 15 being so dimensioned and shaped peripherally as to define a circular guide 16. In the supporting structure 13, moreover, linear guide portions 17 and 18, respectively for throwing and returning or recovering the carrier 3, are provided which are substantially tangent to the circular guide 16. The flywheel 15 is integral with the shaft 19, supported by the structure 13 and driven by the machine own drive means, not shown, at an angular velocity such as to produce a flywheel peripheral speed equal to the desired throwing speed.

The flywheel 15 is provided with carrier entraining means, e.g. a pawl or dog 20 (or even a number of such pawls 20), projecting from the flywheel periphery and preferably seated resiliently in a seat 21 of the flywheel under the action of a bias spring 22 which tends to hold the pawl out of the bottom of the flywheel 15 peripheral groove.

At the connection area of the linear portion 17 with the circular guide 16, a swingable door 23 is located rigid at one end of an arm 24 mounted pivotally on the structure 13 at 25 so as to be swingable in a plane perpendicular to the axis of the flywheel 15. The door 23 is housed in an aperture of the structure 13 and has an arcuate shape such as to define a peripheral wall portion of the circular guide 16 when in the closed position illustrated in FIG. 2. At the end of the arm 24 opposite to the door, the end of a spring 26 is attached, the other end thereof being attached to the structure 13 at 27. A locking lever 28, pivotally mounted to the projection 29 of the structure 13 and program controlled between the positions shown in dotted and full lines in FIG. 2 allows the door 23 to be opened. The timed opening of this door for the carrier throwing is obtained for example through a cam control, including a cam 30 having a recessed portion 31 and followed by the tip of an arm 32 rigid with the arm 24. The cam 30 is driven to rotate by the shaft 19 through a pair of gears 33,34 so designed that one revolution of the cam 30 corresponds to one or more complete revolutions of the flywheel 15. As deductible from FIGS. 2 and 6, the embodiment shown is so conceived that the opening of the door 23 is only made possible when the lever 28 is in the position shown in dotted lines in FIG. 2 (corresponding to that shown in full lines in FIG. 6). In the unreleased condition shown in full lines in FIG. 2, the door 23 cannot be opened and the arm 32 simply overrides the low portion 31 of the cam, since the biassing action of the spring 26 is absent, with no danger for the whole assembly. The opening of the door 23, i.e. the shifting of the stop lever 28 to the position shown in dotted lines in FIG. 2, is controlled by a central control system: the stop lever 28 is normally held in the dotted position shown in FIG. 2 (corresponding to the position shown in full lines in FIG. 6), thus allowing the opening of the door 23 at each revolution of the cam 30, whereas, in the event of a thread breaking or for other reasons, it can be driven to the position shown in full lines in FIG. 2, thereby to prevent the opening of the door and thus the throwing of the carrier, even if the flywheel is rotating.

At the connection area of the linear recovery or return portion 18 with the circular guide 16, a swingable door 35 is provided which is configurated such as to complete the outer peripheral part of the circular guide 16 in said connection area. The door 35 may be moved automatically to the position of FIG. 6 when the carrier arrives, or may be shifted under control.

A bobbin carrier 36 is arranged fixedly on the support structure 13 and supports a spool 37 carrying the weft thread 8. The numeral 38 denotes a vacuum nozzle effective to hold the thread 8 within the path of the carrier emerging from the throwing assembly 6 (FIG. 2), the nozzle being located upstream with respect to the cutting members 9.

FIG. 7 shows how the throwing assembly 6 is timed to the movement of the sley 10, as required, the motion both of the assembly 6 and the sley being derived from the main drive shaft 39. The shaft 19 of the flywheel 15 is driven through a bevel gear pair 40, while for the reciprocating motion of the sley 10 there is provided, in a known manner, a reciprocating structure 41 which carries the sley 10 and is linked to the loom frame at 42. The reciprocating structure 41 carries the eyelets 43 for guiding the carrier and, on the opposite side, a cam following roller 44, arranged to engage a cam 45. Such an engagement is ensured by a spring 46. The ratios of the various gears and the angular arrangement of the cams 30 and 45 are such as to produce one stroke of the sley after each throw, after the carrier has crossed the shed. The numeral 47 denotes the heddles, of conventional design, and 48 the beam taking up the cloth 49.

The operation of the device just described is the following.

The carrier 3, before being thrown, is centrifuged in the structure 13 by means of the flywheel 15 and pawl 20, the door 23 being closed. Thus, the carrier acquires the necessary throw off velocity, which had been reduced during the preceding cycle. At a suitable instant, as allowed by the stop 28, the door 23 opens under the action of the cam 30, and the carrier starts along the linear throwing portion 17 emerging at a very high speed from the structure 13. Facing the latter, there is a weft thread 8, suction drawn by the vacuum nozzle 38 and arranged in the very path of the carrier which then catches the weft thread in its movement, as explained hereinafter. The carrier then passes through the eyelets 43 entraining the weft thread. On emerging from the shed, before the carrier reaches the entry 50 of the guide 4, the weft thread is cutt off on one side by the cutting device 9, while the end on the other side is released from the carrier in a manner to be explained owing to the action of a device shown schematically at 51. The free end of the thread unwound from the spool 37 is suction drawn by the vacuum nozzle 38 and is caused to be positioned at a pick up position for the next insertion of the weft.

The carrier 3, after leaving the weft thread, enters the portion 4*a* of the guide and is progressively deviated without being stopped entirely, thereby it continues in its movement with an energy only slightly smaller than the throwing energy, the difference being due to the losses occurring during the entrainment of the weft thread. The carrier 3 continues its stroke through the linear return portion of the guide 4 and re-enters, still at very high speed, the circular guide 16. Here it is reached by the flywheel pawl 20, which rotates faster, i.e. at the throwing peripheral speed. The carrier is then brought once again to the throwing speed level after one or more revolutions of the flywheel 15, with a very moderate consumption of energy, since the carrier has retained most of its energy and speed. From now onwards, a new throwing step or cycle takes place, as described. The resilient arrangement of the pawl 20 prevents damage in the event that the carrier enters the guide 16 at the very moment the pawl 20 passes by.

A carrier effective to engage the weft thread and release it while moving, as required by the device described hereinabove, is shown in FIGS. 8 to 11. It comprises, in the example illustrated, a gripper with two arms 52,53 journaled at 54 and so shaped as to define a thread entering recess 55 in the forward portion, a clamp between the adhering surfaces 56,57 and a following widening 58. A stop member 59 is provided at the rear end, which is mounted pivotally to one of the arms, preferably the upper one 52, and presents a shaped end which matches the rear end of the other arm 53, whereby the gripper is normally held closed and prevented from opening. The weft thread 8 is caused to enter the entering recess 55 during the gripper movement and remains locked therewithin since it tends to wedge into the apex wherefrom the adhering walls 56,57 originate.

In order to open the gripper and release the thread a longitudinal groove 60 is provided in the gripper arm locked by the stop member 59, said groove extending along the arm length up to the end engaged by the member 59. That groove is entered by the obstacle 51 located at the shed end before the entry 50 of the guide 4, which obstacle, on striking the member 59 during the relative movement between the gripper and the obstacle, causes said member 59 to swing to the position shown in FIG. 11, allowing the arms 52,53 to open and to release the thread. Said release action is also facilitated by the provision of the widening 58. As visible in FIG. 1, the obstacle 51 is very near to the entry 50 of guide portion 4*a* so that when the obstacle 51 engages the member 59 the gripper carrier 3 has already entered the guide portion 4*a* and can no more be deviated out of its path. The opening of the two arms 52,53 may be made automatic by reason of the location of the pivot point 54 between the gripper center of gravity and the rear part of the gripper, or may be favored by a light torsion spring intervening between the two arms.

The invention just described is susceptible of numerous modifications and variations, all of which fall within the inventive concept. Thus, for example, a plurality of consecutively operating carriers may be provided. In fact. while one of the carriers is being accelerated by the assembly 6 another may insert the weft thread and a further one may return to the assembly 6, the number of consecutively operating carriers depending principally from the size of the loom. An accelerating device may also be provided in the return portion before the assembly 6 at the arcuate guide portion 4*a*. In addition, between the spool 37 and thread guide 7, a thread supply may be provided so as to reduce the tractive effort on the thread during the entrainment thereof by the carrier, or possibly in order to avoid too sudden a tearing action as the moving carrier picks up the thread. Furthermore, the thread could be supplied to the carrier already within the guide 16, e.g. by feeding the thread through the flywheel shaft and the entrainer 20, in which case the thread would be attached to the carrier at its tail portion, as provided by the Sulzer looms. The guide 4 may, obviously, have a cross-section configuration different from the one shown herein. The door 23 control may also be different from the one described hereinabove, for instance electromagnetic, responsive to a flywheel revolution counter or tachometer device.

I claim:

1. A shuttleless loom of the type having unidirectional weft thread carriers, comprising a throwing and recovering device for at least one of said carriers, wherein said device includes a guide for causing said at least one of said carriers to move along a closed path one portion of which passes through the shed, said guide including a linear throw portion and a linear return portion and two arcuate portions connecting said linear portions at opposite sides of the loom, said device comprising at at least one of said arcuate portions a circular guide portion substantially tangent to said linear return portion and to said linear throw portion, a flywheel rotatably arranged within said circular guide portion and defining the inner wall thereof, said flywheel being provided with entraining means for said at least one of said carriers, and means for causing said at least one of said carriers to make at least one complete revolution within said circular guide portion and to be thrown out of said circular guide portion into said throw portion after said at least one complete revolution.

2. A loom according to claim 1, wherein at the connection area of said circular guide portion with said linear throw and return portions of said guide there are arranged swingable doors having an arcuate shape such as to define peripheral wall portions of said circular guide portion in the closed position of said doors, at least the door arranged at said throw portion being associated with a control means for the opening and closing thereof in timed relationship with the rotation of said at least one of said carriers together with said flywheel.

3. A loom according to claim 2, wherein said means for controlling the opening and closing of said throw door comprises a cam rotatable at a rotational speed timed to the flywheel rotatable speed and provided with a recessed portion, and a cam following arm rigid with said door and engaging said cam.

4. A loom according to claim 3, further comprising locking means associated with said cam control means for inactivating said throw door independently of said cam control means, said locking means being program controllable.

5. A loom according to claim 1, wherein said entraining means comprises at least one pawl resiliently projecting from said flywheel.

* * * * *